US007330675B2

(12) United States Patent
Stevenson et al.

(10) Patent No.: US 7,330,675 B2
(45) Date of Patent: Feb. 12, 2008

(54) POWER CONTROL FOR A MULTI-LAMP FUSING APPARATUS IN A XEROGRAPHIC PRINTER

(75) Inventors: Duncan I. Stevenson, Smallford (GB); Peter J. Cresswell, Welwyn Garden City (GB)

(73) Assignee: Xerox Corporation, Norwalk, CT (US)

( * ) Notice: Subject to any disclaimer, the term of this patent is extended or adjusted under 35 U.S.C. 154(b) by 156 days.

(21) Appl. No.: 11/350,136

(22) Filed: Feb. 8, 2006

(65) Prior Publication Data

US 2007/0183804 A1 Aug. 9, 2007

(51) Int. Cl.
*G03G 15/20* (2006.01)
*G03G 15/00* (2006.01)

(52) U.S. Cl. ..... 399/67; 399/88

(58) Field of Classification Search ..... 399/67, 399/88, 328, 330

See application file for complete search history.

(56) References Cited

U.S. PATENT DOCUMENTS

| | | | | |
|---|---|---|---|---|
| 4,340,807 | A | 7/1982 | Raskin et al. | |
| 4,372,675 | A | 2/1983 | Sahay | |
| 5,669,038 | A * | 9/1997 | Kishimoto | 399/67 |
| 5,826,152 | A | 10/1998 | Suzuki et al. | |
| 5,854,959 | A | 12/1998 | Mirabella, Jr. | |
| 6,901,226 | B2 * | 5/2005 | Claassen | 399/67 |
| 2003/0103778 | A1 | 6/2003 | Meads et al. | |

* cited by examiner

*Primary Examiner*—Sandra L. Brase
(74) *Attorney, Agent, or Firm*—Robert Hutter

(57) ABSTRACT

A fusing apparatus for xerographic printing includes two lamps therein. There is applied to the first lamp a first wave set and to the second lamp a second wave set, each wave set comprising a predetermined arrangement of active half-cycles for each time period. The first wave set and second wave set are related to substantially minimize simultaneous active half-cycles in each time period.

8 Claims, 3 Drawing Sheets

POWER CONTROL FOR A MULTI-LAMP FUSING APPARATUS IN A XEROGRAPHIC PRINTER

TECHNICAL FIELD

The present disclosure relates to a fusing apparatus, as used in electrostatographic printing, such as xerographic printing or copying, and methods of operating thereof.

BACKGROUND

In electrostatographic printing, commonly known as xerographic or printing or copying, an important process step is known as "fusing". In the fusing step of the xerographic process, dry marking material, such as toner, which has been placed in imagewise fashion on an imaging substrate, such as a sheet of paper, is subjected to heat and/or pressure in order to melt or otherwise fuse the toner permanently on the substrate. In this way, durable, non-smudging images are rendered on the substrates. Fusing of print sheets is also known in other types of printing.

U.S. Pat. Nos. 4,340,807 and 4,372,675 disclose the use of AC "cycle stealing" for precise control of power supplied to a xerographic fusing apparatus.

U.S. Pat. No. 5,826,152 discloses a fuser roll in which the heating elements are disposed within a hollow cylindrical tube inside the roll. Each heating element is independently controllable.

U.S. Published Patent Application 2003/0103778, now abandoned, discloses power control to a dual-lamp fuser, using additional half-cycles as requested power is increased.

SUMMARY

According to one aspect, there is provided a method of operating a fusing apparatus for xerographic printing, including two lamps therein. There is applied to the first lamp a first wave set and to the second lamp a second wave set, each wave set comprising a predetermined arrangement of active half-cycles for each time period. The first wave set and second wave set are related to substantially minimize simultaneous active half-cycles in each time period.

According to another aspect, there is provided a method of operating a fusing apparatus for xerographic printing, including two lamps therein. There is applied to the first lamp a first wave set and to the second lamp a second wave set, each wave set comprising a predetermined arrangement of active half-cycles for each time period. The first wave set and second wave set are related to substantially maximize interleaving of active half-cycles between the first wave set and the second wave set.

DETAILED DESCRIPTION

Figure 1:
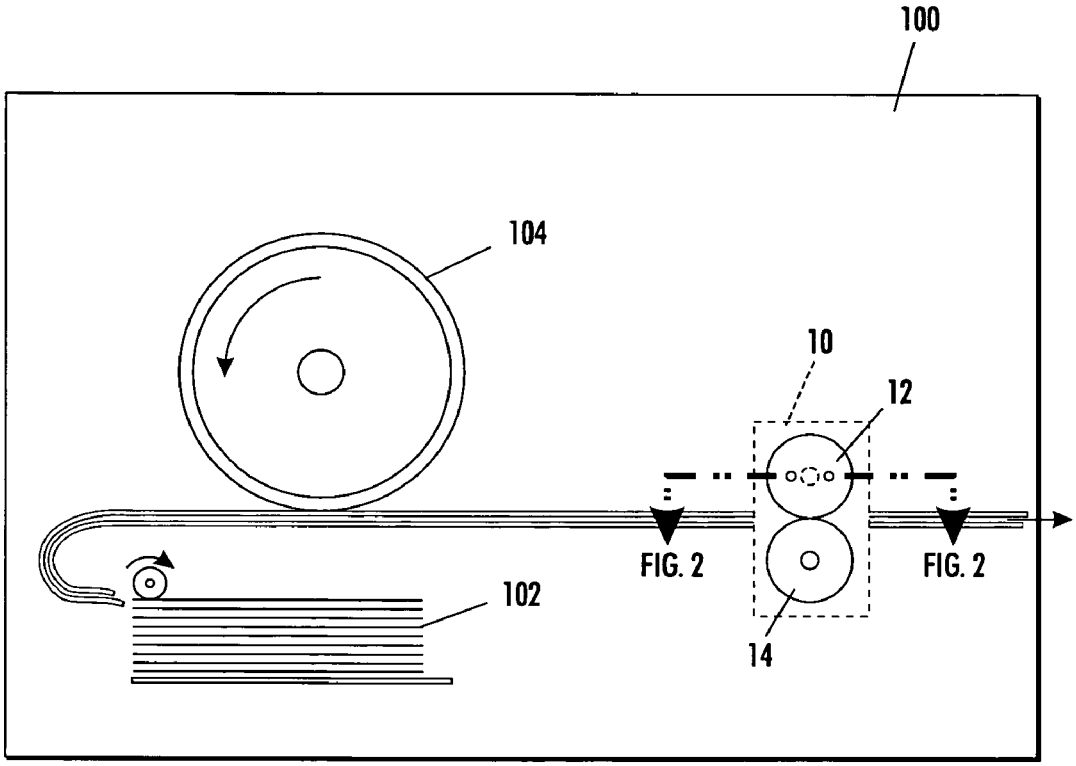
FIG. 1 PRIOR ART
FIG. 1 is a simplified elevational view showing the essential portions of an electrostatographic printer, such as a xerographic printer or copier, relevant to the present disclosure.

FIG. 1 is a simplified elevational view showing the essential portions of an electrostatographic printer, such as a xerographic printer or copier, relevant to the present disclosure. A printing apparatus 100, which can be in the form of a digital or analog copier, "laser printer", ionographic printer, or other device, includes mechanisms which draw substrates, such as sheets of paper, from a stack 102 and cause each sheet to obtain a toner image from the surface of a charge receptor 104, on which electrostatic latent images are created and developed through well-known processes. Once a particular sheet obtains marking material from charge receptor 104, the sheet is caused to pass through a fusing apparatus such as generally indicated as 10. Depending on a particular design of an apparatus, fusing apparatus 10 may be in the form of a fuser module that can be removed, in modular fashion, from the larger apparatus 100.

A typical design of a fusing apparatus 10 includes a fuser roll 12 and a pressure roll 14. Fuser roll 12 and pressure roll 14 cooperate to exert pressure against each other across a nip formed therebetween. When a sheet passes through the nip, the pressure of the fuser roll against the pressure roll contributes to the fusing of the image on a sheet. Fuser roll 12 further supplies heat to the sheet in addition to the pressure, further enhancing the fusing process.

Figure 2:
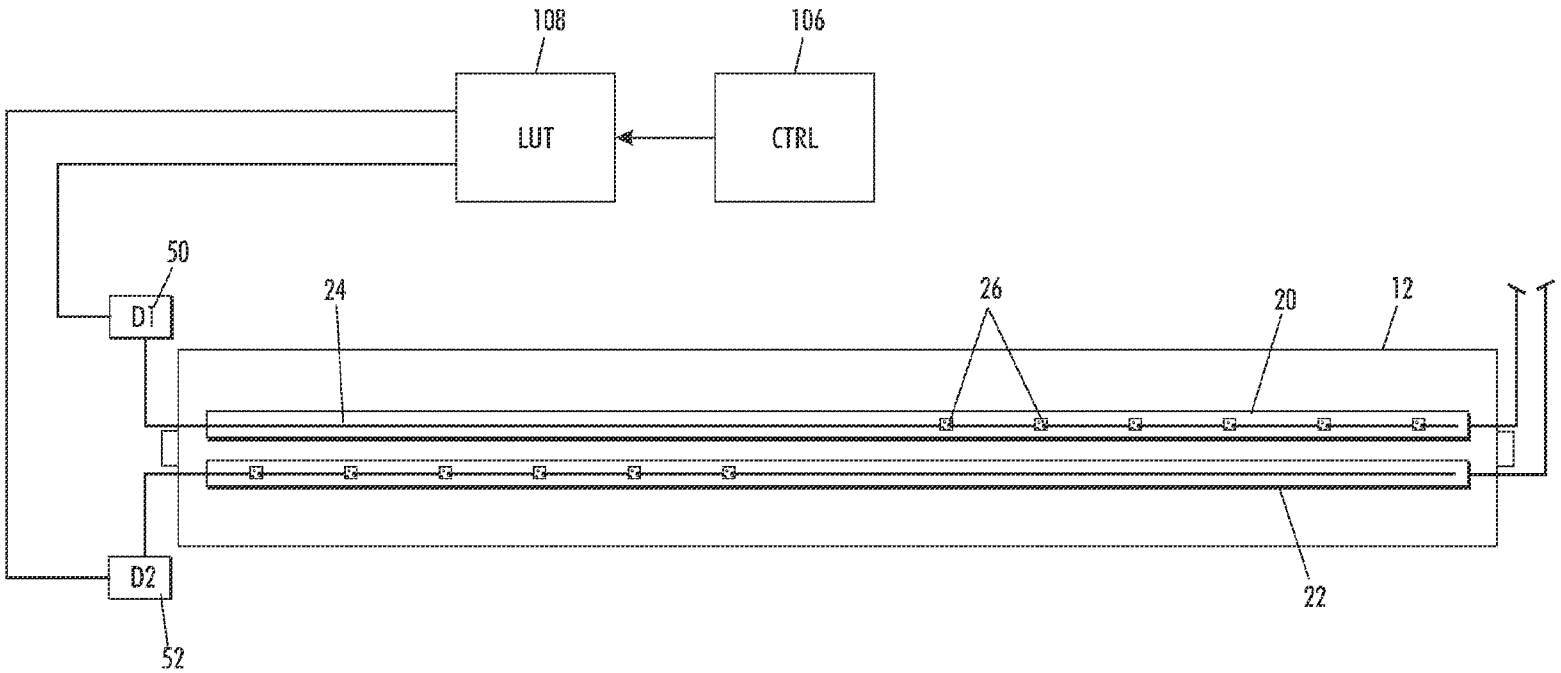
FIG. 2 is a sectional view of the fuser roll as viewed through the line marked 2-2 in FIG. 1, in combination with elements of a control system.

FIG. 2 is a sectional view of the fuser roll 12 as viewed through the line marked 2-2 in FIG. 1. As can be seen in the Figure, there is disposed within the interior of fuser roll 12 two "lamps," meaning structures which incorporate heating elements, indicated as 20 and 22. The lamps 20 and 22 are each disposed along the axial length of the fuser roll 12, and as such are disposed to be largely perpendicular to a direction of passage of the sheets passing through the nip of the fusing apparatus 10.

As can be seen in FIG. 2, in the embodiment each lamp, such as 20, includes a specific configuration of heat-producing material, in this particular case, a relatively long major portion of heat-producing material 24, along with a number of smaller portions of heat-producing material, indicated as 26, which are connected in series. It will be noted that, within each lamp such as 20 or 22, major portion 24 is disposed toward one particular end of the fuser roll 12, while the relatively smaller portions 26 are disposed toward the opposite end of the fuser roll 12. The relatively hot end of lamp 22 is disposed adjacent the relatively cold end of lamp 20, and vice versa. In a practical embodiment, the heat-producing material substantially comprises tungsten, while the overall structure of the lamp is borosilicate glass: these materials are fairly common in the fuser-lamp context.

Also shown in FIG. 2 are simplified renderings of a control system 106, operative of at least the fusing system of a printing apparatus, and a look-up table (LUT) 108, which in turn sends information to the drivers 50, 52 (i.e., suitable circuit elements) operative of each lamp 20, 22. In the overall operation of a printing apparatus or the fusing system, at various times, different combinations of power levels will be required for the lamps 20, 22. In various situations, such as processing sheets of particular sizes, or just a need to warm up one particular lamp more than the other, there will be a need for a significantly higher power drain to one or the other of the two or more lamps. In brief, such situations can cause practical problems with power consumption in the overall system.

According to one embodiment, in a two-lamp fusing apparatus such as shown in FIG. 2, when different combinations of power levels to the lamps are requested, the different power levels are supplied by cycle stealing to each lamp; however, the arrangement of active (i.e., "on") half-cycles to each lamp per time period is coordinated. In particular, two basic approaches are applied. First, within each time period there should be a minimum of half-cycles when both lamps are receiving energy. Second, and possibly alternatively, between the power to the two lamps, there should tend to be a maximum of interleaving of active half-cycles within each time period, so that an active half-cycle to one lamp is followed by an active half-cycle to the other lamp.

Figure 3:
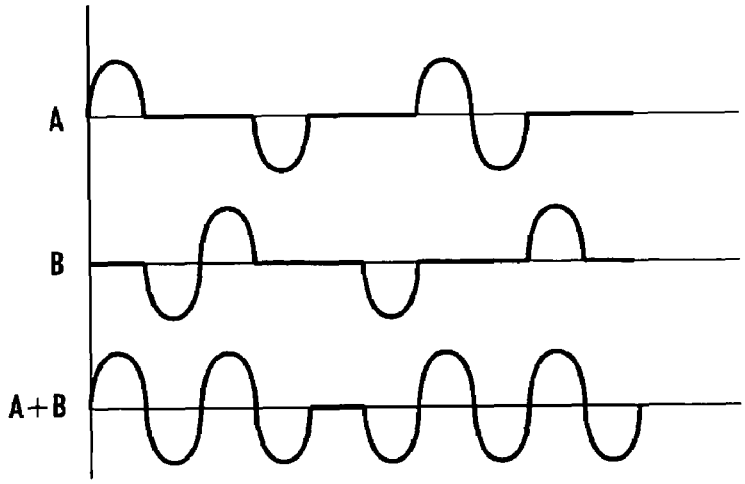
FIGS. 3 and 4 are sets of comparative waveforms, controlling heating elements in a fuser roll, illustrating an operating principle.
Figure 4:
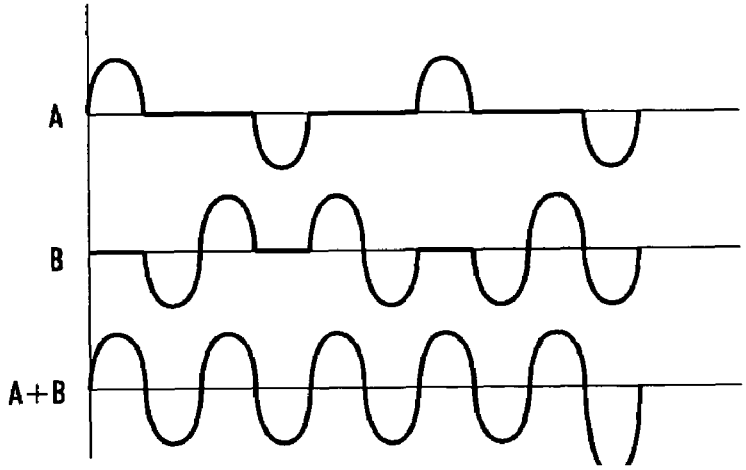

Two examples of arrangements of half-cycles to each lamp 20, 22 are shown respectively in FIGS. 3 and 4. In FIG. 3 is shown an arrangement of half-cycles, for a five-cycle (i.e., ten-half-cycle) period, for a 40% power level (four half-cycles out of ten) to each of the two lamps, here indicated as lamp A and lamp B. As can be seen, the waveforms of active half-cycles to the two lamps are generally similar but displaced in time within the period. As can be seen in the A+B waveform, when the two waveforms to the lamps are added together, eight out of ten half-cycles are active and two out of ten half-cycles see no power being sent to either lamp. Also, in no half-cycle is power sent to both lamps, and the "both off" half-cycles are spread out maximally within the period.

In FIG. 4 is shown an arrangement of half-cycles, for a five-cycle period, for a 40% power level (four half-cycles out of ten) to lamp A and a 70% power level (seven half-cycles out of ten) to lamp B. Once again, there can be seen an arrangement that interleaves active half-cycles to the two lamps in the course of each time period. Also, as can be seen, at only one half-cycle, the last, is power supplied to both lamps simultaneously, as evidenced by the relatively high amplitude in the A+B waveform in the last half-cycle.

In the above-described embodiment, a five-cycle (ten-half-cycle) period for the control system 106 is used as an example; in practical embodiments, the relevant period can be designed to include any number of AC cycles. Also, the relative polarities of the half-cycles in any arrangement may need to be taken into account with regard to a power supply for the system.

Returning to FIG. 2, there is shown a control system 106, operative of at least the fusing system of a printing apparatus, and a look-up table (LUT) 108, which in turn sends information to the drivers 50, 52 operative of each lamp 20, 22. In the embodiment, the LUT 108 retains data relating to arrangements of half-cycles for the drivers 50, 52 of the two lamps 20, 22 according to the above-described desired properties. In a system specifying power levels in increments of ten percent for 0 to 100% power to each of two lamps, a LUT 108 could include in a small memory arrangements for 100 possible combinations of power levels, examples of which are shown in FIGS. 3 and 4. In a practical embodiment, however, only a relatively small number of power level combinations are actually invoked by a control system 106; nonetheless, half-cycle arrangements are retained in LUT 108 for all the combinations of power levels that are likely to be used.

Although a two-lamp fusing apparatus is illustrated and described, the claims can be applied to a fusing apparatus having three or more lamps, and the arrangements of active half-cycles can be arranged accordingly. In various embodiments, the lamps need not all be disposed within a single fuser roll, as shown in the embodiment, but may be disposed in various places relative to the path of a print sheet. Also, the above-described control of multiple lamps or heating elements can be applied to other AC loads found within printers of various types, such as for tray heaters.

As used herein, the terms "maximum" and "minimum" should be construed broadly, and not to imply that any arrangement of half-cycles is a mathematically provable maximum or minimum.

The invention claimed is:

1. A method of operating a fusing apparatus used in printing, the fusing apparatus including a first lamp and a second lamp, comprising:

applying to the first lamp a first wave set and applying to the second lamp a second wave set, each wave set comprising a predetermined arrangement of active half-cycles for each time period; and for each of a plurality of selected combinations of power levels for the lamps, the first wave set and second wave set being related to substantially minimize simultaneous active half-cycles in each time period.

2. The method of claim 1, the first wave set and second wave set being related to substantially maximize interleaving of active half-cycles between the first wave set and the second wave set.

3. The method of claim 1, further comprising applying a selection of power level combinations to a look-up table, the look-up table retaining data for a plurality of predetermined arrangements of half-cycles for the first wave set and second wave set.

4. The method of claim 1, the first lamp and second lamp being disposed inside a fuser roll.

5. A method of operating a fusing apparatus used in printing, the fusing apparatus including a first lamp and a second lamp, comprising:

applying to the first lamp a first wave set and applying to the second lamp a second wave set, each wave set comprising a predetermined arrangement of half-cycles for each time period; and the first wave set and second wave set being related to substantially maximize interleaving of active half-cycles between the first wave set and the second wave set.

6. The method of claim 5, the first wave set and second wave set being related to substantially minimize simultaneous active half-cycles in each time period.

7. The method of claim 5, further comprising applying a selection of power level combinations to a look-up table, the look-up table retaining data for a plurality of predetermined arrangements of half-cycles for the first wave set and second wave set.

8. The method of claim 5, the first lamp and second lamp being disposed inside a fuser roll.

* * * * *